US006011520A

United States Patent [19]

Howell et al.

[11] Patent Number: 6,011,520

[45] Date of Patent: Jan. 4, 2000

[54] GEODESIC SLOTTED CYLINDRICAL ANTENNA

[75] Inventors: James M. Howell, Woodstock; Thomas E. Sharon, Alpharetta, both of Ga.

[73] Assignee: EMS Technologies, Inc., Norcross, Ga.

[21] Appl. No.: 09/025,136

[22] Filed: Feb. 18, 1998

[51] Int. Cl.[7] ..... H01Q 13/10; H01Q 13/12

[52] U.S. Cl. ..... 343/769; 343/767; 343/768; 343/770; 343/771

[58] Field of Search ..... 343/769, 767, 343/768, 770, 771; H01Q 13/10, 13/12

[56] References Cited

U.S. PATENT DOCUMENTS

| | | | |
|---|---|---|---|
| 3,871,000 | 3/1975 | Tymann | 343/771 |
| 4,112,431 | 9/1978 | Wild | 343/768 |
| 4,185,289 | 1/1980 | DeSantis et al. | 343/770 |
| 4,458,250 | 7/1984 | Bodnar et al. | 343/768 |
| 5,266,961 | 11/1993 | Milroy | 343/772 |

FOREIGN PATENT DOCUMENTS

| | | |
|---|---|---|
| 0047684 | 3/1982 | European Pat. Off. . |
| WO 96/09662 | 3/1996 | WIPO . |

*Primary Examiner*—Don Wong
*Assistant Examiner*—Hoang Nguyen
*Attorney, Agent, or Firm*—Jones & Askew, LLP

[57] ABSTRACT

A geodesic slotted cylindrical (GSC) antenna having a shaped elevation pattern and a narrow or shaped azimuth beam that can be scanned 360° in the azimuth plane. The azimuth radiation pattern of the GSC antenna can be reconfigured through the use of interchangeable beam forming feed networks. The GSC antenna comprises a parallel plate waveguide formed by spaced-apart inner and outer cylinders constructed from conductive material. Radiation occurs from a stack of circumferential slots in the outer cylinder. By varying the slot spacing with the azimuth angle, the elevation pattern can be altered as a function of the azimuth angle. The GSC antenna can be excited by a number of equally spaced probes on a circle at the base of the cylinders. The feed radius is typically smaller than the outer cylinder's radius to minimize the number of active components and to minimize the number of spurious ray paths that can wrap around inside the cylinder's parallel plate region. The probes can be phased so that rays from each probe will travel between the parallel cylindrical plates and radiate from the slots to produce a beam that is focused in azimuth. The elevation pattern can be scanned or altered by mechanically moving a tapered dielectric insert within the parallel plate region.

39 Claims, 6 Drawing Sheets

GEODESIC SLOTTED CYLINDRICAL ANTENNA

TECHNICAL FIELD

The present invention relates to an antenna for communicating electromagnetic signals, and more particularly relates to a geodesic slotted cylindrical parallel plate antenna having a shaped elevation pattern and either a narrow or shaped azimuth beam.

BACKGROUND OF THE INVENTION

The main purpose of an antenna is to control a wave front at the boundary between a source (e.g., a feed probe) and the medium of propagation (e.g., air). An antenna enables the radiation of electromagnetic (EM) energy from the source into the medium of propagation. The radiation of EM energy has been accomplished in a number of ways through the use of antennas of various sizes and configurations.

A common waveguide antenna is the slot or aperture antenna. The slot antenna is typically constructed from a conductive material having one or more slots. The slot antenna radiates EM energy into the propagation medium from each slot in the conductive material. When current is introduced to the conductive material, the slot disrupts the current flow causing an electric field to be induced across the area including the slot.

Slot antennas can be implemented as a slot cut into the conductive surface of a parallel planar plate waveguide comprising two parallel conducting planar plates separated by a dielectric slab of uniform thickness. Parallel planar plate waveguides provide a means of propagating EM energy and directing the energy to a radiator. Where a slot is cut into the parallel planar plate waveguide, the slot is the radiator. The size of the slot determines how much EM energy will be radiated.

In many antenna applications (e.g., telecommunications and radar), it is necessary to design antennas with good directive characteristics to meet the demands of the long distance communications required by the particular application. This can be accomplished by increasing the electrical size of the antenna. One means of increasing an antenna's electrical size is to enlarge the dimensions of the antenna's radiating components. Another common means is to form an assembly of radiating elements in an array. The individual radiating elements of an array may be of any form (e.g., wires or slots) and the resulting radiation pattern of the array is an aggregate of the individual elements' radiation patterns.

When rapid beam scanning or multiple beams are required, phased arrays are often used. Although planar arrays are common, multiple array faces are required to generate radiation patterns of 360° in the azimuth plane. Cylindrical arrays can be used to generate such radiation patterns. However, in practical applications, the radiation patterns of the individual elements of the cylindrical array interfere such that the radiation pattern of the array may be less than ideal. Moreover, the cylindrical array typically uses a complex lossy feed network to commutate the excitation around the cylinder and only some of the elements are used at a given scan angle making power handling more difficult and increases the sensitivity to error. At frequencies above 30 GHz, the design of planar and cylindrical arrays of discrete radiators becomes more difficult in that while the available area per element becomes quite small, each element must be equipped with a variety of support components, such as radiating elements, phase shifters, attenuators, dc power distribution, connectors, logic circuits, etc.

One variation on the conventional parallel planar plate waveguide is the geodesic parallel plate waveguide. A geodesic parallel plate waveguide can be created by forming a parallel plate waveguide from conformal structures, such as a pair of cylinders, made from a conductive material. More specifically, by placing a cylinder of conductive material within another cylinder of conductive material, a parallel plate waveguide can be formed with each cylinder representing the opposing plates of the waveguide. The parallel plate waveguide formed thereby has no side walls. Because the geodesic waveguide is circumferential, it can scan a 360° radiation pattern in the azimuth plane. Furthermore, it is superior to the cylindrical array, in that it can be fed from a smaller feed region. Unlike the cylindrical array, the EM energy from the input feed of the geodesic cylinder is simultaneously phased and spatially distributed to form the radiation pattern. The additional components required by the cylindrical array are thus eliminated or minimized.

The essence of the geodesic structure is that the EM energy is forced to follow geodesic paths between the parallel plates. EM energy will follow the most direct path between two points. The use of the geodesic parallel plate structure and phased feed probes provides a well focused radiation pattern in azimuth. These benefits are a result of the propagation of EM energy through the structure However, while previously manufactured geodesic antennas have provided good radiation pattern characteristics in the azimuth plane, they have failed to provide the ability to generate a shaped pattern in the elevation plane. Current geodesic antennas have failed to provide a shaped pattern in the elevation plane, because they have been designed to produce a radiation pattern at a single annular opening at the top-most portion of the conformal structure (i.e., where the parallel plates terminate). Attempts at controlling the elevation pattern of these geodesic antennas include locating horns, reflectors, lenses, and line sources at the single output opening. While these control means are effective for focusing a beam in the elevation plane, they are ineffective for shaping a radiation pattern in the elevation plane. These modifications extend the vertical height of the antenna and greatly increase the horizontal dimension if a small flare angle is used for the horn aperture. In applications, such as telecommunications, the desired radiation pattern of a geodesic antenna may differ depending on the demands of a particular market. The control means listed above are incapable of providing the control ability necessary to accommodate the various desired radiation patterns.

Moreover, current geodesic antennas also tend to produce spurious rays of EM energy, because the physical structure of the geodesic antenna supports a multitude of ray paths between a feed point and the radiation element. Spurious rays can produce destructive interference with the desired ray paths. This causes undesirable ripples in the pattern associated with a given feed port which degrades the azimuth pattern when all feed probes are simultaneously excited.

Therefore, there is a need for a geodesic antenna that is capable of forming a focused narrow beam, omni pattern beam, or sector shaped beam in the azimuth direction. The antenna should also be capable of generating a radiation pattern with shaped coverage in the elevation plane and should provide a high degree of control over the shape of the elevation plane radiation pattern. The antenna should minimize the generation of spurious rays of EM energy. Furthermore, there is a need for a geodesic antenna that is designed such that it is inexpensive to manufacture and minimizes the need for additional components, while being adaptable to changing radiation pattern requirements.

SUMMARY OF THE INVENTION

The present invention solves the problems of prior antennas by providing a cylindrical parallel plate antenna having continuous, circumferential slots in an outer cylindrical plate. The antenna is capable of providing a shaped elevation pattern and an azimuth pattern that can be a narrow beam scanned 360° or can be an omni-directional beam. The antenna comprises a parallel plate region formed by an inner conductive cylinder and an outer conductive cylinder. Radiation can occur from a stack of circumferential slots in the outer cylinder.

The present invention utilizes the body of the outer cylindrical parallel plate as a radiation device. Specifically, circumferential slots can be cut into the outer cylindrical parallel plate and radiate EM energy. By providing a stack of radiating elements, rather than just a single radiation ring at the top of the antenna, the antenna is capable of providing a shaped radiation pattern in the elevation plane. The shape of the pattern in the elevation plane can be controlled by means of varying the parameters of the circumferential slots, such as the width of the slots and the distance between the slots. The shape of the pattern in the elevation plane can also be varied in azimuth by making the spacing between the slots vary with azimuth.

Feed probes can protrude through a base plate in the outer cylinder and into the parallel plate region to excite the antenna. The feed probes can be equally spaced around a feed probe circle. The feed probe circle can be smaller than the diameter of both the outer and the inner cylinders. A smaller feed probe circle minimizes the generation of spurious rays within the antenna by directing the rays toward the outer cylinder. By controlling the angle of incidence of any given EM energy ray at a transition point between the base plate and the cylindrical parallel plate region, the present invention suppresses the generation of spurious EM energy rays that can create unwanted interference and distort the desired radiation pattern.

In another aspect of the invention, the parallel plate region formed by the inner cylinder and the outer cylinder is filled with a dielectric material that has a dielectric constant higher than that of ambient air. The dielectric material can also be shaped and repositioned within the parallel plate region, causing the circumferential slots to experience varying dielectric constants. The introduction of a dielectric into the parallel plate region permits control of the wavelength of the EM energy in the antenna. Thus, the phase of the EM energy can be controlled so that the spacing between slots can be altered. Where the spacing between the slots is non-uniform, the varying dielectric constant can provide for the generation of in-phase EM energy waves.

The present invention can be implemented as a parallel plate waveguide with any conformal structure. For example, co-extensive, concentric cones may also be used as parallel plate waveguides for the purposes of the present invention. Because of the simplicity of the design of the present invention, such conformal parallel plate waveguides are low-loss devices and can be inexpensive to equip with circumferential slots.

The various aspects of the present invention may be more clearly understood and appreciated from a review of the following detailed description of the disclosed embodiments and by reference to the appended drawings.

DETAILED DESCRIPTION

Figure 1:
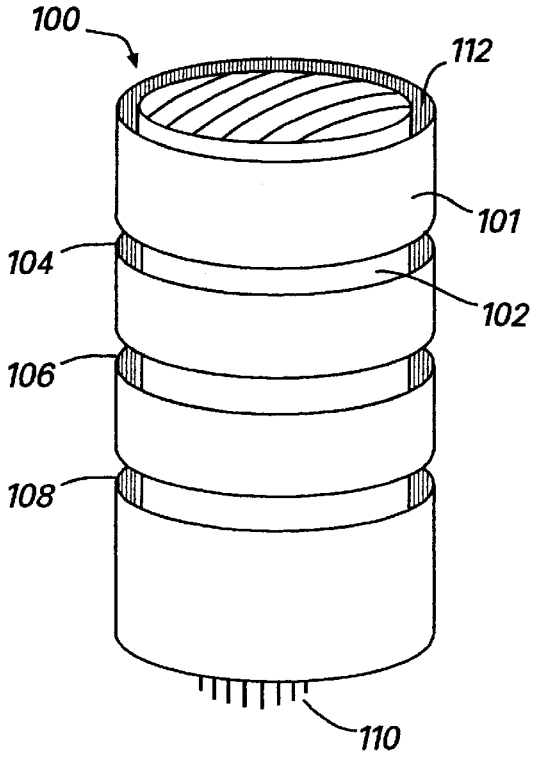
FIG. 1 is a perspective view of a geodesic slotted cylindrical (GSC) antenna having parallel, spaced apart inner and outer conductive cylinders in accordance with an exemplary embodiment of the present invention.

The present invention is directed to a cylindrical slotted antenna otherwise described as a geodesic slotted cylindrical (GSC) antenna capable of providing a shaped elevation pattern and an azimuth pattern that can be a narrow beam scanned 360° or can be an omni-directional or shaped beam. The GSC antenna comprises a parallel plate region formed by an inner conductive cylinder and an outer conductive cylinder. The communication of electromagnetic (EM) energy occurs from a stack of circumferential slots in the outer cylinder. Various exemplary embodiments of the GSC antenna are described by referring to the drawings in which like reference numbers refer to like elements.

GEODESIC SLOTTED CYLINDRICAL ANTENNA

FIG. 1 is a perspective view of the top and the side of an exemplary embodiment of the geodesic slotted cylindrical (GSC) antenna 100. This embodiment of the GSC antenna 100 includes two spaced-apart cylinders, an outer cylinder 101 and an inner cylinder 102 and is capable of reciprocal communication (i.e., transmit and receive). The outer cylinder 101 and the inner cylinder 102 are fabricated from conductive material, such as aluminum or copper. The region between the inner cylinder 102 and outer cylinder 101 is a cylindrical gap 112, which can include a dielectric material, such as air or polystyrene. The cylindrical structure resulting from the coaxial arrangement of the inner cylinder 102, the outer cylinder 101, and the cylindrical gap 112 constitutes a parallel plate waveguide, with the inner cylinder 102 and the outer cylinder 101 operating as the opposing parallel plates. In this context, "coaxial" is used to describe the situation in which two or more physical structures (e.g., cylinders) share a common longitudinal axis.

The outer cylinder 101 has one or more slots such as the three slots 104, 106, 108, which are cut completely through the conductive material of the outer cylinder 100 exposing the inner cylinder 102. The resulting stack of slots furnishes a set of radiators for the GSC antenna 100. The GSC antenna 100 can be excited by a number of equally spaced probes 110 arranged in a circle at the base of the GSC antenna 100. For example, the probes 110 can be equally spaced along a radius at the base plate of the outer cylinder 100. The radiation pattern generated by the excited antenna can be selectably adjusted by connecting various feed networks to the feed probes 110. Alternative feed networks are described in more detail below, in connection with FIGS. 6*a*–6*c*.

Figure 2:
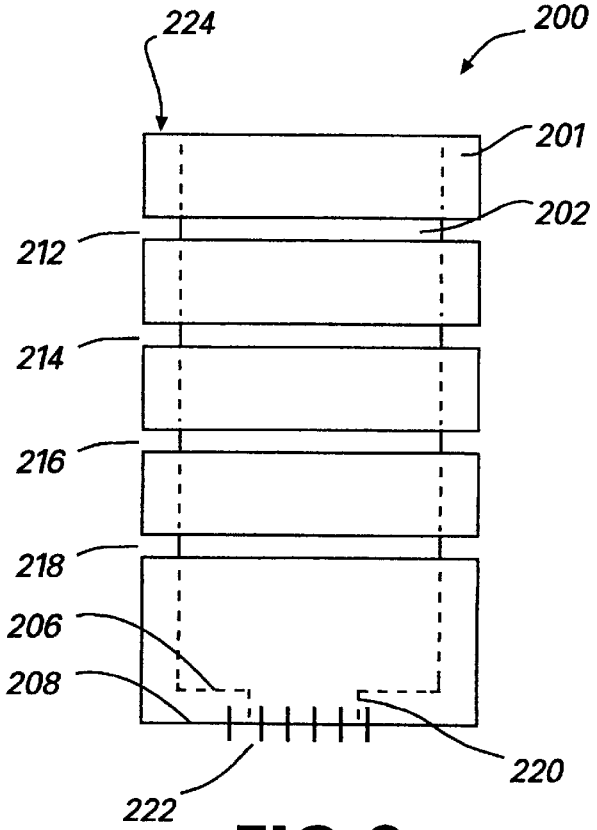
FIG. 2 is a side view of the GSC antenna shown in FIG. 1 and depicting the spatial relationship of the inner and outer conductive cylinders and of other major components of the GSC antenna.

FIG. 2 illustrates a side view of an exemplary embodiment of a reciprocal GSC antenna 200. The hidden lines show how the inner cylinder 202 is positioned within the outer cylinder 201 and is exposed at the positions where the slots are cut into the outer cylinder 201. The GSC antenna 200 comprises four slots 212, 214, 216, 218. Both the inner cylinder 202 and the outer cylinder 201 have base plates (206 and 208, respectively) that are disc-shaped and enclose the base of each cylinder, except in a region defined by the feed probe cylinder 220.

Feed probes 222 protrude through the outer cylinder base plate 208 and into a cylindrical gap 224, allowing the feed probes 222 to launch EM energy into the dual cylinder structure when the feed probes 222 are excited. The feed probe wall 220 is a third cylinder that is coaxial with the inner cylinder 202 and the outer cylinder 201. The feed probe wall 220 connects the inner cylinder base plate 206 and the outer cylinder base plate 208 and provides the only directly conductive connection between the inner cylinder 202 and the outer cylinder 201. Because the feed probe cylinder 220 backs the feed probes 222, the propagation of the EM energy from the feed probes 222 is towards the direction of the outer cylinder 201. The structure comprising the inner cylinder 202, the outer cylinder 201, the feed probe wall 220 and the base plates 206, 208 constitutes a waveguide capable of guiding EM waves.

The feed probes 222, are preferably equally spaced around a feed probe circle, which has a diameter in a range between the diameter of the feed probe wall 220 and the diameter of the inner cylinder 202. The diameter of the feed probe circle can be made smaller than the diameter of both the inner cylinder 202 and the outer cylinder 201 to minimize the number of active components and to minimize the number of spurious ray paths that can wrap around inside the GSC antenna's parallel plate region. The concept of spurious rays and their prevention is discussed in more detail below, in connection with FIGS. 3*a* and 3*b*.

The slots 212, 214, 216, 218 can be formed by removing portions of the outer cylinder 201. Alternatively, the slots can be formed such that they flare outward. Those skilled in the antenna arts will appreciate that slots of varying configurations can be utilized with embodiments of the present invention to form various radiation patterns, depending on the requirements of a particular antenna application. Various configurations for forming radiating slots are well known to those skilled in the antenna arts.

The parallel plate portion of the GSC antenna can be terminated (at the top of the GSC antenna) into an EM energy absorber (not shown) to absorb any EM energy that has not been coupled into the propagation medium through the stack of slots. Various kinds of rigid foam materials are commonly used as EM energy absorbers. The purpose of the absorber is to minimize EM energy reflections that may be destructive to a desired radiation pattern. Alternatively, the parallel plate region can be terminated with a ground plane at the top to produce a resonant cavity with the standing wave fields coupled to the slots.

GEODESIC RAY PATHS

One of the fundamental reasons for utilizing a geodesic antenna is to provide a low cost antenna that is capable of generating a radiation pattern that can provide an omni-directional pattern, 360° in the azimuth plane, or a narrow azimuth beam that can be scanned 360°. If a parallel plate structure is utilized, the polarization of the EM energy within the parallel plate region can be perpendicular to the inner cylinder 202 and outer cylinder 201 and the cylindrical gap 224 can be made narrow enough such that only transverse-electromagnetic (TEM) modes are supported by the GSC antenna. Propagation within the plate region is via geodesic ray paths between the probes 222 and the slots 212, 214, 216, 218. The slots disrupt the current flow in the outer cylinder 201, causing an electrical field to be induced across each slot, thereby providing an annular source of radiation from each slot. The slots couple an amount of power from the parallel plate region, that can be varied by varying the width of each slot. Wider slots couple more EM energy out of the plate region than do narrower slots.

As discussed above in connection with FIG. 2, the diameter of the feed probe circle, around which the feed probes are preferably equally spaced, is made smaller than the diameter of the inner cylinder 202 and the outer cylinder 201. The design minimizes the number of active components and reduces the number of spurious ray paths that can wrap around the inside of the parallel plate region. By limiting the incidence angle to the outer cylinder 201 to less than 30°, the number of spurious wraparound rays can be limited to a small number.

A direct ray travels between a feed probe and a radiation point within a given slot via the most direct route. A spurious ray path can also propagate between these points along a "straight" line (i.e., geodesic path that wraps around the cylinder one or more times).

Figure 3A:
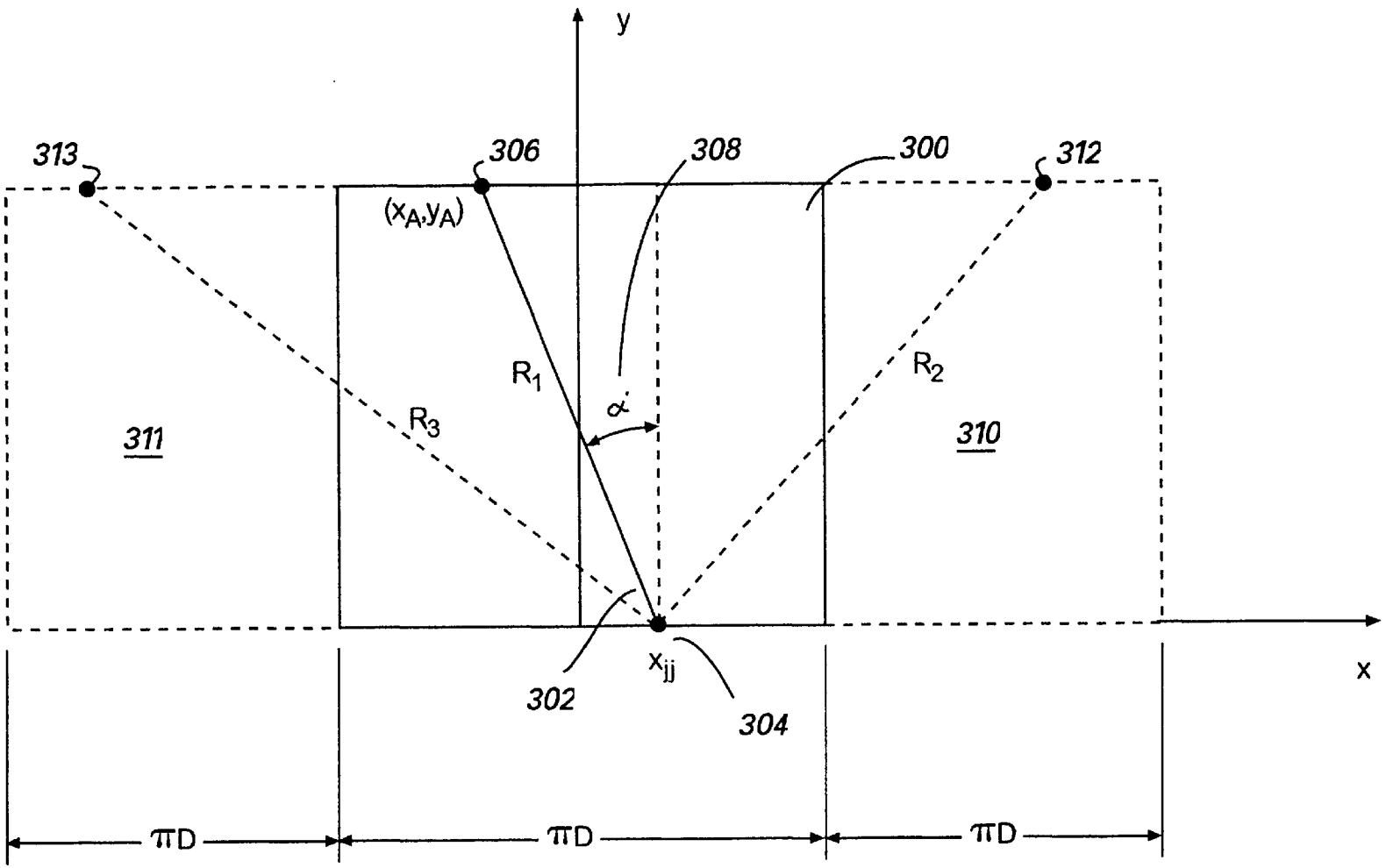
FIG. 3*a* is a depiction of the outer cylinder of the GSC antenna shown in FIG. 1, the outer cylinder flattened for the purposes of illustrating an exemplary ray path.
Figure 3B:
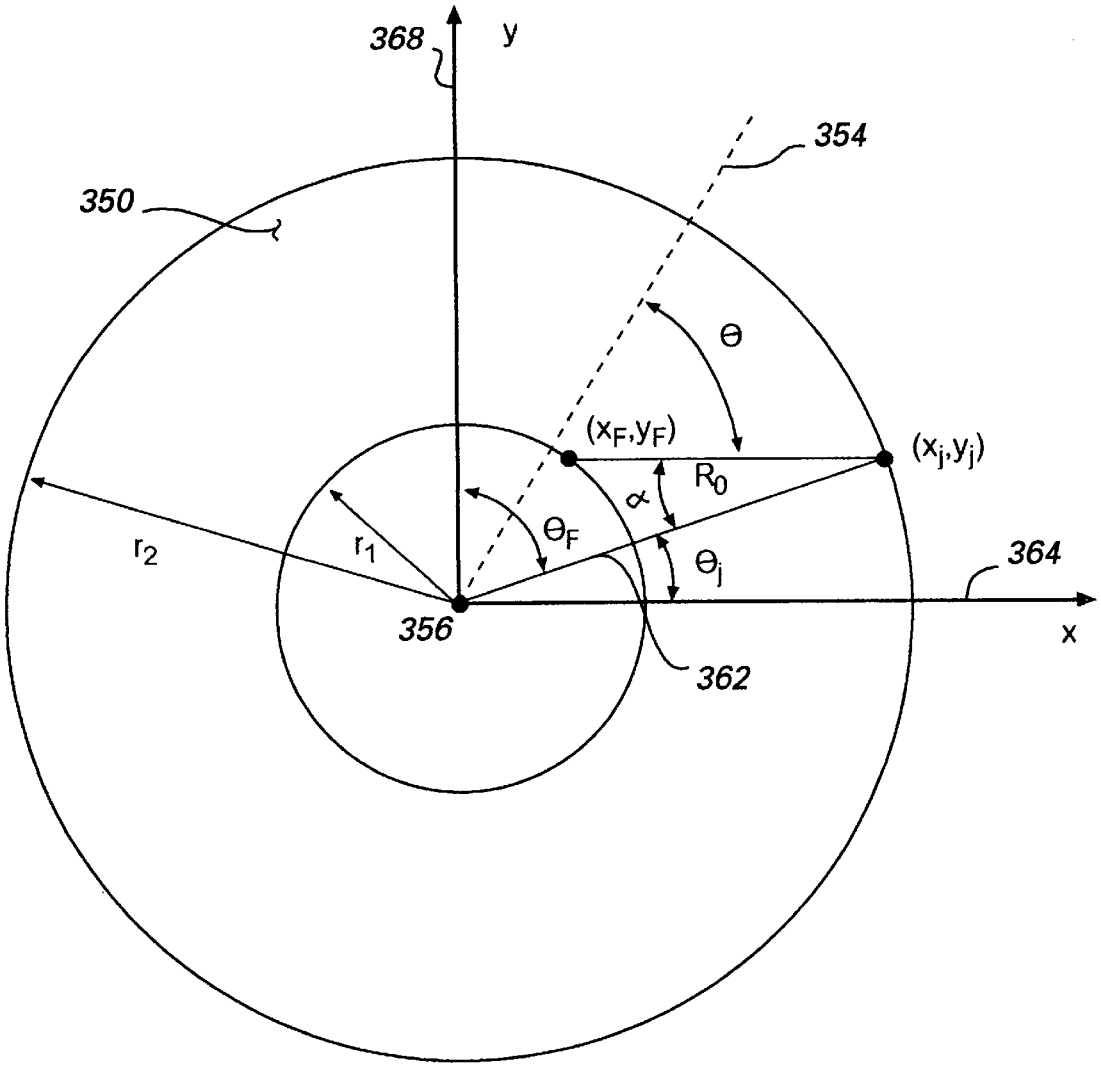
FIG. 3*b* is a depiction of a base plate of the outer cylinder of the GSC antenna shown in FIG. 1 and illustrating an exemplary ray path.

FIG. 3*a* shows a geodesic cylinder 300 as it would look if the cylinder was split longitudinally and flattened. FIG. 3*b* shows a base plate 350 of the geodesic cylinder 300. Also depicted are the images of the cylinder (i.e., 310 and 311) which support a spurious (wraparound) ray in the clockwise or counterclockwise direction. $R_1$, is the path of a direct ray between points 304 and 306. Points 312 and 313 also correspond to point 306. Hence, $R_2$ is a spurious ray path between points 304 and 306, wrapping around the cylinder in a clockwise direction. $R_3$ is also a spurious ray path, but wraps around the cylinder in the counter-clockwise direction.

The derivation below defines the path of an EM energy ray that enters the geodesic cylinder 300 at a given feed point $(x_F, y_F)$ 352 on the base plate 350. A wraparound ray path $R_1$ 302 represents the ray path from a transition point $(x_{jj})$ 304 to a propagation point $(x_A, y_A)$ 306. The transition point $(x_{jj})$ 304 is a point common to the geodesic cylinder 300 and the base plate 350 that represents the point at which the ray travels from the base plate 350 to the geodesic cylinder 300. However, for clarity, the transition point has been labeled $(x_j, y_j)$ 351 in FIG. 3*b*. The propagation point $(x_A, y_A)$ 306 is the point at which a direct ray encounters a slot and is radiated into the propagation medium. The angle between the ray path $R_1$ 302 and the vertical axis is $\alpha'$ 308.

A first radial line 354 can be drawn between the feed point $(x_F, y_F)$ and the center point 356 of the base plate 350. A ray path $R_0$ represents the path of the ray between the feed point $(x_F, y_F)$ and the transition point $(x_j, y_j)$. The angle between the first radial line 354 and the ray path $R_0$ is $\Phi$. A second radial line 362 can be drawn between the center point 356 of the base plate 350 and the transition point ($x_F$, $y_j$). The angle between the second radial line 362 and the ray path $R_0$ is $\alpha$. The angle between the second radial line 362 and the x-axis 364 is $\Phi_j$. The angle between the y-axis 368 and the second radial line 362 is $\Phi_F$. The inside radius of the base plate 350 is $r_1$. The outside radius of the base plate 350 is $r_2$.

Given these variables, the ray path of the wraparound ray can be described by the following derivation:

$$x_F=r_1 \sin \Theta_F$$

$$y_F=r_1 \cos \Theta_F$$

Thus, for any given transition point (x, y):

$$x=x_F+R_0 \sin(\Theta_F+\Theta)$$

$$y=y_F+R_0 \cos (\Theta_F+\Theta)$$

Applying the Pythagorean Theorem:

$$x^2+y^2=r_2^2$$

And substituting the above derived values for x and y:

$$x_F^2+y_F^2+R_0^2+2R_0(x_F \sin(\Theta_F+\Theta)+y_F \cos(\Theta_F+\Theta))=r_2^2$$

Solving for $R_0$:

$$R_0^2+R_0(2r_1 \cos \Theta)+r_1^2-r_2^2=0$$

$$R_0^2+\beta R_0+\gamma=0$$

$$R_0=(-\beta+(\beta^2-4\gamma)^{1/2})/2$$

Therefore:

$$x_j=x_F+R_0 \sin(\Theta_F+\Theta)$$

$$y_j=y_F+R_0 \cos(\Theta_F+\Theta)$$

$$\Theta_j=\tan^{-1}(x_j/y_j)$$

$$x_{jj}=r_2\Theta_j$$

$$\alpha=\Theta_F+\Theta-\Theta_j$$

$$R_1=((x_A-x_{jj})^2+y_A^2)^{1/2}$$

$$\alpha'=\tan^{-1}((x_A-x_{jj})/y_A)$$

At the boundary between the base plate of FIG. 3*b* and the cylinder of FIG. 3*a*, the ray must cross these two surfaces with the same angle (i.e. $\alpha=\alpha'$). The transition point can be found by searching over all $\Theta$ from −90° to 90° and computing $\alpha$ and $\alpha'$ for each $\Theta$. If $\alpha=\alpha'$ for any $\Theta$, then a valid ray path has been found.

The derivation provides a means for tracing direct and spurious ray paths. By defining a relationship between the inner diameter of the base plate $r_1$, the outer diameter of the base plate $r_2$, the angles of EM energy wave incidence, $\alpha$ and $\alpha'$, and the resulting geodesic ray path, the above derivation provides those skilled in the antenna arts a means for designing a cylindrical geodesic antenna that reduces spurious rays. Note that if $\alpha$ is very large, there may be many possible ray paths. If $r_1$ approaches $r_2$ (i.e., the feed radius is approximately the cylinder radius), $\alpha$ approaches 90° such that a ray could wrap around the cylinder an infinite number of times. As the feed radius $r_1$ approaches zero, $\alpha$ approaches zero and the only permissible ray goes straight up the cylinder wall. While the above description has been directed toward antennas having a single section, the suppression of spurious rays is also a goal for designers of multi-section antennas used to achieve signal diversity and the present invention is easily adaptable to such applications.

OPTIMIZING THE GEODESIC ANTENNA

The performance of the GSC antenna provided by the present invention can be optimized in various areas. Three areas affecting performance optimization will be discussed with respect to exemplary embodiments: the physical dimensions of the GSC antenna; the use of a dielectric material other than air in the cylindrical gap; and the use of various feed networks. These areas are discussed with reference to FIGS. 4, 5*a*–5*b*, and 6*a*–6*c*, respectively.

THE GSC ANTENNA'S PHYSICAL DIMENSIONS

The physical dimensions of the GSC antenna can affect its ability to produce a shaped radiation pattern in the elevation plane. Most dimensions are related to the operational wavelength ($\lambda$) of the GSC antenna and/or the desired Half Power Beamwidth in the elevation plane ($HPBW_{EL}$) or in the azimuth plane $HPBW_{AZ}$. The HPBW is the angle between the two directions in which the radiation intensity of a beam is one-half of the maximum value of the beam. Accordingly, most of the dimensions provided will be provided in terms of $\lambda$ or HPBW.

Figure 4:
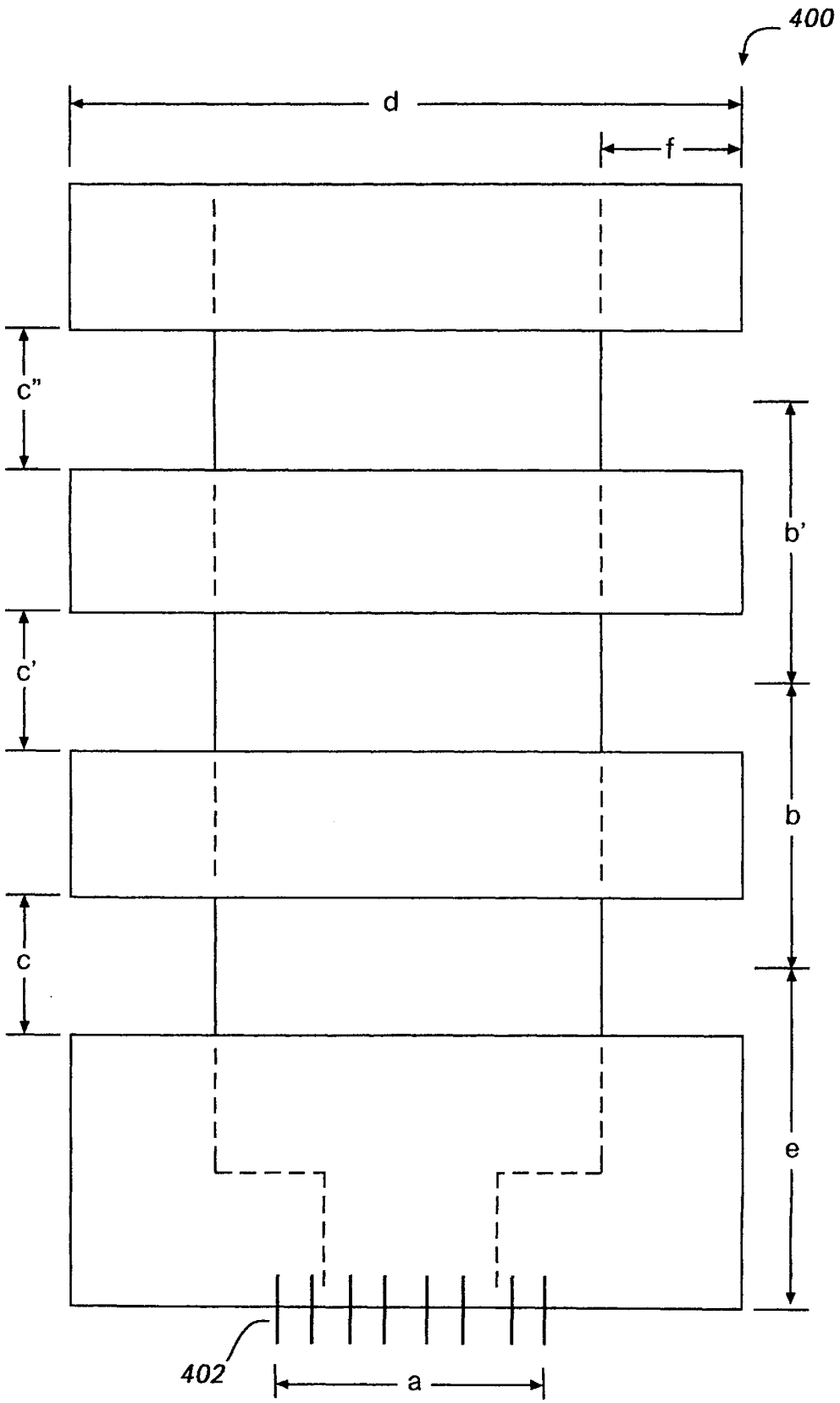
FIG. 4 is a side view of the GSC antenna shown in FIG. 1 and illustrating the dimensional ranges for the major components of the GSC antenna.

Referring now to FIG. 4, an exemplary embodiment of the GSC antenna is shown with variables indicating the various dimensions of the antenna. The details of the GSC antenna shown in this figure have been exaggerated in order to more clearly show the dimension lines. The figure does not represent a scale embodiment of the GSC antenna.

The diameter d of a GSC antenna 400 is typically determined by the desired azimuth beamwidth. An exemplary relationship between the beamwidth and the diameter d is represented by the formula: $HPBW_{EL}=60\lambda/d$. For example, for a 15° $HPBW_{EL}$, the approximate diameter d would be $4\lambda$.

The diameter d of the GSC antenna 400 determines the number of feed probes 402 that can be positioned around the feed probe circle. The number of feed probes should be maximized to enable smooth phasing among the probes to form a desired radiation pattern (theoretically, an infinite number of probes is ideal). However, a relatively small number yields acceptable radiation pattern performance at a low cost. The number of probes that can be positioned within the feed probe circle is limited by physical constraints. The cables and other components required to provide the signal to the feed probes 402 typically reduce the space available for more feed probes 402. When too few probes are utilized, azimuth plane grating lobes can be created, thereby reducing the gain in the antenna pattern in the main beam direction. The appropriate number of feed probes 402 varies from about $180/HPBW_{AZ}$ to about $360/HPBW_{EL}$. It is desirable to use the minimum number of feed probes 402 to reduce cost, but the antenna sidelobes rise as the number for feed probes 402 decrease. The number of feed probes 402 determines the number of azimuthal modes that can be used to synthesize the azimuth pattern from a Fourier Series viewpoint.

Typically, the center-to-center slot spacings, b and b' range from $0.5\lambda$ to $1.0\lambda$. The separation between slots determines the phase between slots. By varying the slot spacing with the azimuth angle, the radiation pattern in the elevation plane can be altered (i.e., shape and/or direction) as a function of the azimuth angle. The size of the parallel plate gap f depends on power handling and is typically in the range of 0.1λ to 0.25λ. The slot widths c, c',c" determine the power coupling and typically are between 0.1 and 0.5 times the width of the parallel plate gap f, or between 0.01λ and 0.125λ. To keep the coupled energy uniform, the slots can be made wider, the closer they are to the top of the antenna (i.e., c">c'>c).

The number of slots determines the beamwidth of the beam in the elevation plane. More slots produce a radiation pattern that has a narrower HPBW in the elevation plane. Less slots produce a radiation pattern that has a wider HPBW in the elevation plane. Accordingly, the number of slots depends largely on the antenna application in which the GSC antenna 400 is utilized. For example, in a radar application, a narrower beam may be required, while in a telecommunications application, a wider beam may be required. Those skilled in the art will recognize that varying the number of slots is but one way to alter the shape of the resulting radiation pattern. Other ways of altering the shape of the radiation pattern will be discussed below, in connection with FIG. 6.

The base height e is typically between 1λ and 6λ, and affects the phase taper of an EM energy ray as it travels between slots. The radiation pattern of the GSC antenna 400 in the azimuth plane is roughly a mean of the azimuth radiation patterns of all of the slots. Necessarily, there will be some differential in the radiation pattern from slot to slot. However, by increasing the base height e, the effect of this differential on the azimuth radiation pattern of each slot is reduced.

THE CYLINDRICAL GAP

Figure 5A:
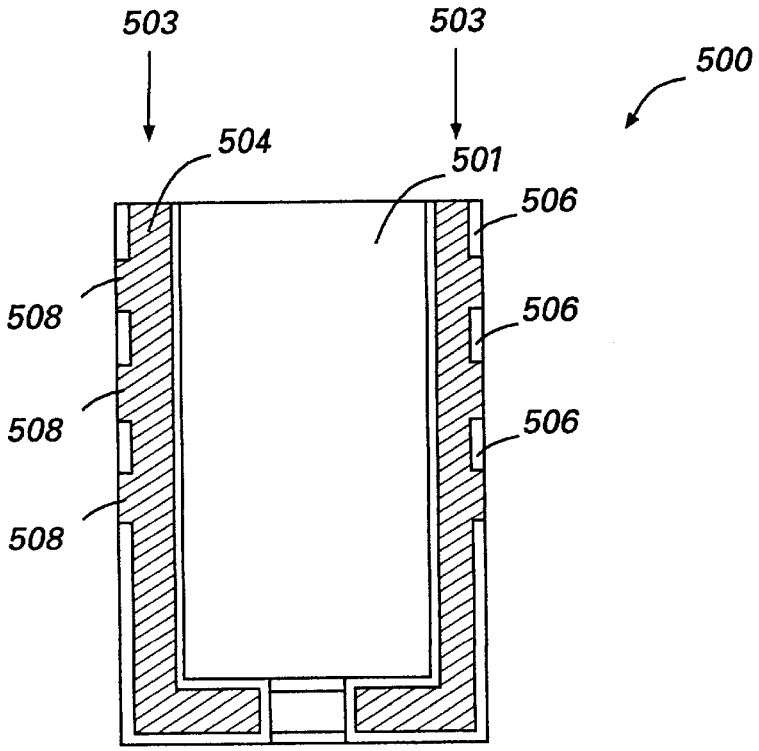
FIG. 5*a* is a cross sectional side view of the GSC antenna shown in FIG. 1 and illustrating a non-air dielectric filling a cylindrical gap between the inner cylinder and the outer cylinder of the GSC antenna.
Figure 5B:
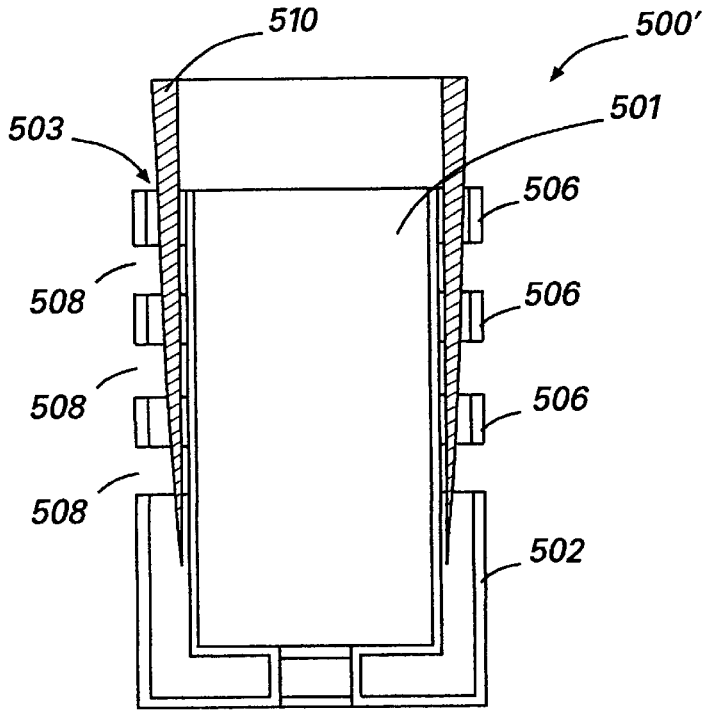
FIG. 5*b* is a cross sectional side view of the GSC antenna shown in FIG. 1 and illustrating a tapered non-air dielectric positioned within a cylindrical gap between the inner cylinder and the outer cylinder of the GSC antenna.

Referring now to FIGS. 5*a* and 5*b*, cross-sections of two GSC antennas 500 and 500' are depicted. FIG. 5*a* depicts the cross section of a GSC antenna 500 wherein the cylindrical gap 503 is filled with a non-air dielectric material 504, such as polystyrene or Rexolite, a polystyrene material manufactured by the DuPont Corporation. As discussed above in connection with FIGS. 1 and 2, the cylindrical gap 503 separates the inner cylinder 501 from the outer cylinder 502. In this illustration of the GSC antenna 500, the dielectric material 504 that fills the cylindrical gap is indicated in cross-hatching.

The dielectric material 504 fills the cylindrical gap 503 as well as the voids between the circumferential rings 506, that comprise the outer cylinder 502, That is, the slots 508 are completely filled by the dielectric material 504.

The amount of phase shift that an EM energy ray will experience as it travels from one slot 508 to the next, depends on the dielectric constant of the media through which it travels. In a dielectric, such as polystyrene, the ray travels slower, making the wavelength λ smaller. Assuming that a radiation pattern is desired in which all of the slots 508 radiate in phase, slots 508 and circumferential rings of non-varying widths would be appropriate for use with the constant dielectric depicted in FIG. 5*a*. In order to form an elevation beam nearly broadside to the GSC antenna 500, the slots 508 should be excited in-phase and spaced less than a wavelength apart to avoid forming grating lobes at high and low elevation angles. This can be easily achieved by loading the parallel plate region with a high dielectric material so that energy can arrive at the slots 508 in-phase even though the slots 508 are closely spaced. The elevation pattern can be shaped (i.e., null filled) via nonuniformly spacing the slots 508 as a means of phase control in the elevation direction. The slotted parallel plate wrapped around a cylindrical inner surface structure of the GSC antenna 500 is an inexpensive way to form the radiating slot in that it avoids discrete radiators. A more detailed discussion of feed networks capable of providing phase control will be provided below, in connection with FIG. 6.

However, referring now to FIG. 5*b*, a tapered dielectric material 510 could be used to vary the dielectric constant between the slots 508 of the GSC antenna 500'. If the parallel plate region is completely filled with a dielectric material, with a dielectric constant (ϵ) of approximately 2.5, and the slots are spaced $\lambda/\epsilon^{1/2}$, the slots will be excited in-phase. If, the dielectric material is removed from the parallel plate region, the beam can be scanned in elevation by $\Theta=\sin^{-1}((\epsilon^{1/2}-1)/\epsilon^{1/2})$.

The variable dielectric constant allows the radiation pattern of the GSC antenna 500' to be scanned in elevation. For example, in a radar application, the desired elevation pattern may change. The tapered dielectric material 510 would allow the GSC antenna 500' to be readily scanned by moving the tapered dielectric 510 along its longitudinal axis. Another example in which the tapered dielectric material 510 would provide a beneficial function is where the GSC antenna 500' is used in a moving environment, such as on a ship. As the ship moves, the GSC antenna could be tuned to accommodate the changed conditions by moving the tapered dielectric 510 along its longitudinal axis. In telecommunications applications, where the environment may include dense or semi-dense foliage, the communications characteristics of the antenna may change with the seasons. Accordingly, the elevation beamwidth adjustments enabled by this embodiment are often required to accommodate such changes.

FEED NETWORKS

Various feed networks that are well known to those skilled in the antenna arts can be used with the GSC antenna to provide radiation patterns of varying characteristics. The antenna can be scanned 360° in the azimuth plane, or can generate an omni-directional radiation pattern in the azimuth plane. The azimuth pattern is controlled by the excitation of the N feed probes 110 (FIG. 1) located on a circle at the base of the GSC antenna. Exciting the N feed probes 110 (FIG. 1) with equal amplitude and equal phase will produce an omni-directional pattern which can be used as a radar sidelobe blanker or for a broadcast mode in telecommunications. If phase shifters at the feed probes are correctly set, a focused beam can be formed in a given direction. The beam can be scanned electronically in the azimuth plane by varying the phase shifter settings. The phase shifters can be ferrite, diode, or MMIC devices depending upon power level, reciprocity, acceptable losses, and switching speed. The sidelobes of the beam can be varied by varying the amplitude taper across the probes. The power divider can be a fixed divider (e.g. uniform amplitude) or a VPD (variable power divider) network if both amplitude and phase control are needed. On receive, multiple beamforming networks can be configured following an LNA (low noise amplifier) per element to provide multiple, fixed beams of arbitrary shape. Another receive architecture uses an attenuator and phase shifter after an LNA to produce a receive beam that can scan in azimuth and change its pattern. Three feed networks that will be discussed below are a passive network, a variable power divider network, and a power divider network. All three networks are designed to connect to the feed probes 110 (FIG. 1) that excite the GSC antenna. All three feed networks are conducive to reciprocal communication.

Figure 6A:
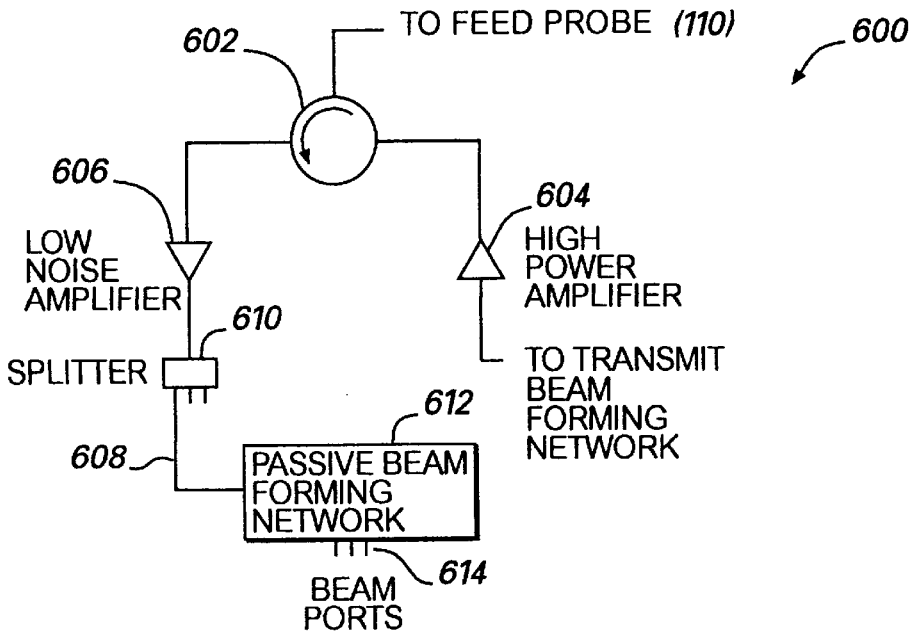
FIGS. 6*a*, 6*b*, and 6*c* depict alternative feed networks for use with the GSC antenna shown in FIG. 1 to produce radiation patterns with various desired characteristics.

A passive network 600 is depicted in FIG. 6*a*. The passive network 600 shown includes a circulator 602 that is connected to each feed probe 110 (FIG. 1). The transmit side of the circulator 602 has a solid state FET high power amplifier (HPA) 604. Not shown is the transmit beamforming network (BFN) including phase shifters. On the receive side of the circulator 602 is a low noise amplifier (LNA) 606 that sets the noise figure so that lossy passive BFNs 612 can be used. The output of the LNA 606 is divided by a splitter 610 and fed via coaxial cable 608 into each of the passive BFNs 612. The passive BFNs 612 use microstrip or stripline couplers (not shown) to weight the probes to form a particular shaped sector beam. The beam ports 614 provide simultaneous outputs that can be connected to multiple fixed receivers (not shown) or switched into a single receiver (not shown). The passive BFNs 612 can use push-on or standard SMA connectors allowing a given passive BFN 612 to be readily changed in the field and replaced with one that produces a different pattern if desired. In a cellular phone application, the antenna can be located at the top of the tower and the passive BFNs 612 could be located at the bottom of the tower where it is easier to swap passive BFNs 612.

The passive network depicted in FIG. 6*a* is commonly used in telecommunications application, where multiple fixed beams are desired. Advantageously, where a different radiation pattern is desired, the passive BFNs 612 can be replaced, thereby altering the radiation pattern. In telecommunications applications where the GSC antenna is at a remote location, such as the top of a tower, the passive BFNs 612 can be placed near the ground so that replacement is easier.

Figure 6B:
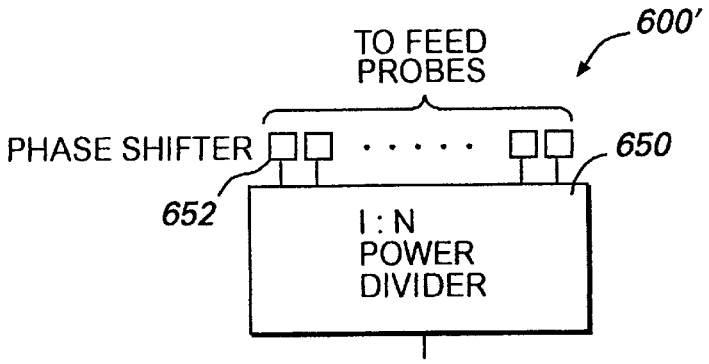
Figure 6C:
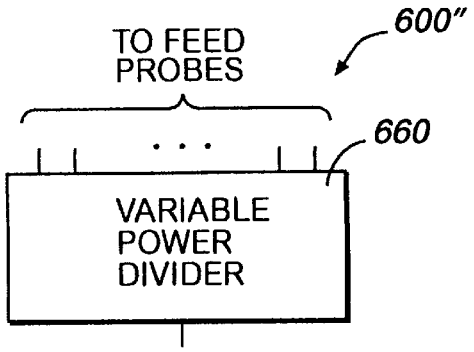

The feed networks depicted in FIGS. 6*b* and 6*c* are functional variations of one another. These feed networks are used in applications in which a single, omni-directional or focused beam is required. The feed network 600' depicted in FIG. 6*b* can be used for either transmit or receive or both (where the GSC antenna has N feed probes 110 (FIG. 1)) and consists of a 1:N power divider 650 followed by a phase shifter 652 for each probe. Setting the phase shifters 652 in phase will create an omni-directional radiation pattern. The phases of each feed probe 110 (FIG. 1) can also be set to focus a pencil beam focused in azimuth. The number of probe elements must be sufficient to prevent quasi-grating lobes from forming in the azimuth plane. Generally, the number of probes is less than that when multiple planar array faces are used.

The feed network 600" depicted in FIG. 6*c* illustrates the case in which each feed probe 110 (FIG. 1) can be excited with arbitrary amplitude and phase. The variable power divider (VPD) 660 consists of cascaded power dividers whereby each divider consists of a pair of quadrature couplers (not shown) separated by a pair of phase shifters (not shown). The phase difference between the pair of phase shifters controls the amplitude split at that stage and the actual phases of the pair controls the phase. Generally, the feed network of FIG. 6*c* provides everything that the feed network of FIG. 6*b* provides and more (e.g., providing amplitude control for each feed probe). However, the feed network of FIG. 6*b* is a less expensive alternative in that it requires fewer phase shifters and is less lossy.

In sum, an GSC antenna is provided that is capable of providing a shaped elevation pattern and an azimuth pattern that can be a narrow beam scanned 360° or can be an omni-directional beam. The GSC antenna consists of a parallel plate region formed by an inner conductive cylinder and an outer conductive cylinder. Radiation occurs from a stack of circumferential slots in the outer cylinder. The combination of multiple circumferential slots with geodesic phasing control provides a simple, low cost antenna architecture having flexibility and radiation pattern shaping characteristics. Although exemplary embodiments of the GSC antenna are cylindrical antennas, the present invention can also be implemented with other conformal structures, such as cones. It will be understood that the claims that follow define the scope of the present invention and that the above description is intended to describe various embodiments of the present invention. The scope of the present invention extends beyond any specific embodiment described within this specification.

What is claimed is:

1. An antenna, comprising:

a parallel plate waveguide formed by a first cylindrical conductor and a second cylindrical conductor separated by a cylindrical gap, the first cylindrical conductor, the second cylindrical conductor, and the cylindrical gap being coaxial;

a first base plate connected to a base end of the first cylindrical conductor, the first base plate being disc-shaped and having an outside diameter substantially equal to a diameter of the first cylindrical conductor, thereby partially enclosing the base end of the first cylindrical conductor;

a second base plate connected to a base end of the second cylindrical conductor, the second base plate being disc-shaped and having an outside diameter substantially equal to a diameter of the second cylindrical conductor, thereby partially enclosing the base end of the second cylindrical conductor;

a feed probe wall, being ring-shaped and coaxial with the first cylindrical conductor and connecting an inside diameter of the first base plate and an inside diameter of the second base plate;

a plurality of feed probes protruding through the first base plate and into the cylindrical gap, the feed probes being spaced apart at equal distances around the circumference of a feed probe circle, the feed probe circle being coaxial with the first cylindrical conductor and having a diameter greater than a diameter of the feed probe wall;

the second cylindrical conductor being positioned substantially within the first cylindrical conductor;

the first cylindrical conductor having at least one circumferential slot extending along the circumference of the first cylindrical conductor; and each circumferential slot operative to radiate electromagnetic energy, when the feed probes are excited, thereby producing a radiation pattern.

2. The antenna of claim 1, wherein the feed probe circle has a diameter which is less than the diameter of the first cylindrical conductor.

3. The antenna of claim 2, wherein the feed probe circle has a diameter which is less than the diameter of the second cylindrical conductor.

4. The antenna of claim 1, wherein the difference between the outside diameter of the cylindrical gap and the inside diameter of the cylindrical gap is substantially equal to $0.5\lambda$, where $\lambda$ is the wavelength of the electromagnetic energy radiated by each circumferential slot.

5. The antenna of claim 1, wherein each circumferential slot has a width that is between $0.125\lambda$ and $0.0\lambda$, wherein $\lambda$ is the wavelength of the electromagnetic energy radiated by each circumferential slot.

6. The antenna of claim 5, wherein at least one circumferential slot has a width that is larger than a width of a lower circumferential slot.

7. The antenna of claim 1, wherein each circumferential slot is separated from an adjacent circumferential slot by a distance in the range between 0.5λ and 1.0λ, wherein λ is the wavelength of the electromagnetic energy radiated from the slot.

8. The antenna of claim 7, wherein the distance between each circumferential slot and the corresponding adjacent circumferential slot varies with an azimuth plane, whereby an elevation plane radiation pattern can be varied at different angles in the azimuth plane.

9. The antenna of claim 1, wherein the diameter of the first cylindrical conductor is defined by, $D_{FC}=60\lambda/BW$, wherein:

$D_{FC}$ is the diameter of the first cylindrical conductor;

λ is the wavelength of the electromagnetic energy radiated by each circumferential slot; and BW is the half power beamwidth of a desired radiation pattern.

10. The antenna of claim 1, wherein the cylindrical gap comprises a dielectric material.

11. The antenna of claim 10, wherein the dielectric material comprises air.

12. The antenna of claim 11, wherein the dielectric material comprises polystyrene.

13. The antenna of claim 10, wherein the dielectric material can be moved along a longitudinal axis, thereby modifying the shape of the radiation pattern.

14. The antenna of claim 13, wherein the dielectric material is tapered along a portion of the longitudinal axis.

15. The antenna of claim 1, wherein the radiation pattern is characterized by a shaped elevation pattern.

16. The antenna of claim 1, wherein the radiation pattern is characterized by a narrow azimuth beam that can be scanned 360° in an azimuth plane.

17. The antenna of claim 1, wherein the radiation pattern is characterized by an omni-directional shape in the azimuth plane.

18. The antenna of claim 1, wherein the distance between the base end of the first cylindrical conductor and a bottom-most circumferential slot is in the range between 1λ and 6λ, where λ is the wavelength of the electromagnetic energy radiated by each circumferential slot.

19. An antenna comprising:

a cylindrical parallel plate waveguide comprising:

an inner cylinder and an outer cylinder separated by a cylindrical gap, the outer cylinder having at least one circumferential slot for radiating electromagnetic energy; and a plurality of feed probes functionally connected to a base plate of the outer cylinder operable for exciting the cylindrical parallel plate waveguide;

the cylindrical parallel plate waveguide having a radiation pattern that is shaped in the elevation plane.

20. The antenna of claim 19, wherein the feed probes are equally spaced on a feed probe circle having a diameter that is less than a diameter of the outer cylinder.

21. The antenna of claim 20, wherein the diameter of the feed probe circle is less than a diameter of the inner cylinder.

22. The antenna of claim 19, wherein the radiation pattern is characterized by a narrow azimuth beam that can be scanned 360° in an azimuth plane.

23. The antenna of claim 19, wherein the radiation pattern that is characterized by an omni-directional shape in the azimuth plane.

24. The antenna of claim 19, wherein the cylindrical gap comprises a dielectric material.

25. The antenna of claim 24, wherein the dielectric material comprises air.

26. The antenna of claim 24, wherein the dielectric material comprises polystyrene.

27. The antenna of claim 24, wherein the dielectric material can be moved along a longitudinal axis, thereby modifying the shape of the radiation pattern.

28. The antenna of claim 27, wherein the dielectric material is tapered along a portion of the longitudinal axis.

29. The antenna of claim 19, wherein each circumferential slot has a corresponding adjacent circumferential slot, and wherein the distance between each circumferential slot and the corresponding adjacent circumferential slot varies with an azimuth plane, whereby an elevation plane radiation pattern can be varied at different angles in the azimuth plane.

30. An antenna comprising:

a parallel plate waveguide formed by a first conformal conductor and a second conformal conductor separated by a conformal gap, the second conformal conductor being positioned within the first conformal conductor;

a plurality of feed probes protruding into the first conformal conductor, the feed probes being spaced apart at equal distances along a feed probe perimeter; and the first conformal conductor having at least one perimeter slot continuously extending along a perimeter of the first conformal conductor.

31. The antenna of claim 30, wherein the first conformal conductor and the second conductor are coaxial.

32. The antenna of claim 31, wherein the feed probe perimeter and the first conformal conductor are coaxial.

33. The antenna of claim 30, wherein the first conformal conductor comprises a first base plate partially enclosing a base end of the first conformal conductor and the second conformal conductor comprises a second base plate partially enclosing a base end of the second conformal conductor; and wherein the first base plate and the second base plate are joined by a feed probe wall.

34. The antenna of claim 33, wherein the feed probes protrude through the first base plate and into the conformal gap.

35. The antenna of claim 30, wherein the feed probe perimeter is smaller than the perimeter of the second conformal conductor.

36. The antenna of claim 30, wherein each perimeter slot communicates electromagnetic energy, when the feed probes are excited, thereby producing a radiation pattern that is characterized by a shaped elevation pattern.

37. The antenna of claim 30, wherein each perimeter slot communicates electromagnetic energy, when the feed probes are excited, thereby producing a radiation pattern that is characterized by a narrow azimuth beam that can be scanned 360° in an azimuth plane.

38. The antenna of claim 30, wherein each perimeter slot communicates electromagnetic energy, when the feed probes are excited, thereby producing a radiation pattern that is characterized by an omni-directional shape in the azimuth plane.

39. The antenna of claim 30, wherein each perimeter slot has a corresponding adjacent perimeter slot, and wherein the distance between each perimeter slot and the corresponding adjacent perimeter slot varies with an azimuth plane, whereby an elevation plane radiation pattern can be varied at different angles in the azimuth plane.

* * * * *